US006063240A

United States Patent [19]

Eriksson et al.

[11] Patent Number: 6,063,240

[45] Date of Patent: May 16, 2000

[54] PRODUCTION OF PAPER AND PAPER BOARD

[75] Inventors: Per-Ola Eriksson, Domsjo; Ingvar Eriksson, Gidea; Bo Hjalmarson, Gavle, all of Sweden; John Graham Langley, Leeds, United Kingdom

[73] Assignees: Allied Colloids Limited, West Yorkshire, United Kingdom; AB CDM, Goteborg, Sweden

[21] Appl. No.: 08/980,372

[22] Filed: Nov. 28, 1997

[30] Foreign Application Priority Data

Nov. 28, 1996 [GB] United Kingdom ..... 9624832

[51] Int. Cl.[7] ..... D21H 11/00; D21H 13/00

[52] U.S. Cl. ..... 162/162; 162/164.1

[58] Field of Search ..... 162/162, 164.1

[56] References Cited

U.S. PATENT DOCUMENTS

| | | | |
|---|---|---|---|
| 4,753,710 | 6/1988 | Langley et al. | 162/164.3 |
| 4,824,523 | 4/1989 | Wagberg et al. | 162/164.1 |
| 4,913,775 | 4/1990 | Langley et al. | 162/164.3 |
| 4,969,976 | 11/1990 | Reed | 162/164.3 |

FOREIGN PATENT DOCUMENTS

| | | |
|---|---|---|
| 0308752A2 | 3/1989 | European Pat. Off. . |
| WO9502088 | 1/1995 | WIPO . |

*Primary Examiner*—Christopher A. Fiorilla

*Attorney, Agent, or Firm*—Sughrue, Mion, Zinn, Macpeak & Seas, PLLC

[57] ABSTRACT

Paper or paper board is made by adding cationic polymeric retention aid to a cellulosic supension, shearing the suspension to degrade the resultant flocs, aggregating the suspension by adding an aqueous composition of bentonite or other anionic bridging coagulant in the presence of anionic dye, pigment or optical brightening agent, and forming paper from the aggregated suspension.

12 Claims, No Drawings

PRODUCTION OF PAPER AND PAPER BOARD

BACKGROUND OF THE INVENTION

This invention relates to the production of paper or paper board by a process comprising forming an aqueous cellulosic suspension, adding a polymeric retention aid to the suspension to form flocs, degrading the flocs by shearing the suspension to form microflocs, aggregating the microflocs by adding to the suspension an aqueous composition of an anionic bridging coagulant, draining the aggregated suspension to form a sheet, and drying the sheet. Processes of this general type are well known. For instance the Hydrocol (trade mark) process involves these process steps and utilises bentonite (i.e. an anionic swelling clay) as the anionic bridging coagulant. Such processes are described in, for instance, U.S. Pat. Nos. 4,753,710, 4,913,775 and EP-A-707673.

The formation of the flocculated suspension generally involves the addition of one or more cationic polymers to the suspension. For instance the polymeric retention aid is often a high molecular weight cationic polymer, and/or other cationic polymers may be added at earlier stages in the process. For instance cationic starch or other strength additive can be added to increase strength and/or low molecular weight cationic polymers can be added to improve retention and/or for other purposes, such as controlling pitch in the thick stock.

In order to improve the visual appearance of the dried sheets, it is conventional to add an anionic material which will alter the visual appearance of the sheet, such as a pigment or dye or, usually, an optical brightening agent. For reasons of convenience and thorough mixing, these anionic materials are always added at a relatively early stage in the process, certainly before the retention aid and often even at the thick stock stage, for instance in the mixing chest.

Thus a typical process comprises adding an anionic optical brightener to the thick stock with or prior to any filler that is required and then adding cationic starch and/or low molecular weight cationic coagulant (which may have also been added to the thick stock as a pitch control additive), then adding the cationic or other polymeric retention aid and then the anionic bridging coagulant.

Processes of this type have been operated on a very large scale for many years.

In all paper making processes it is desirable to obtain optimum performance utilising a minimum amount of chemical additives. Thus the mill operator wants to achieve optimum pitch control, strength, retention and drainage or other dewatering using a minimum amount of polymer, and optimum visual appearance using a minimum amount of optical brightener, dye or pigment.

SUMMARY OF THE INVENTION

The object of the invention is to provide improved performance in such processes. In particular, one object is to provide improved retention and dewatering (including drainage) performance so as to enable the operator either to use the same amount of chemical additives and obtain increased dewatering and retention performance or to allow the operator to achieve equivalent dewatering and retention performance but with a reduced amount of additives. Another object is to achieve improved visual appearance, thus allowing the operator to achieve increased brightening or colouring using the same dosage of optical brightener, dye or pigment, or to obtain equivalent brightening or colouring at a reduced dose of optical brightener, dye or pigment.

DETAILED DESCRIPTION OF THE INVENTION

According to the invention, a process for making paper or paper board comprises forming an aqueous cellulosic suspension, adding a polymeric retention aid to the suspension to form flocs, degrading the flocs by shearing the suspension to form microflocs, aggregating the microflocs by adding to the suspension an aqueous composition that includes an anionic bridging coagulant, draining the aggregated suspension to form a sheet, and drying the sheet, and in this processes at least one cationic polymer is included in the suspension before the shearing and anionic optical brightening agent and/or dye and/or pigment for the paper or paper board is added to the suspension substantially with the anionic composition of anionic bridging coagulant.

Thus the anionic optical brightener, dye or pigment is added to the sheared suspension either just before, after or more usually with the aqueous composition of anionic bridging coagulant. The materials may be added to the suspension separately but at closely adjacent points or, more usually, they are added at a single addition point. Preferably therefore the anionic optical brightener, dye or pigment is mixed into the aqueous composition of anionic bridging coagulant prior to its addition over the suspension. Thus it may be mixed in-line as the aqueous composition is being fed towards the suspension or it may be pre-mixed.

The invention is applicable to any process where cationic polymer is included in the suspension before the shearing stage and anionic bridging coagulant is added subsequently. In practice this means that it is applicable to substantially all processes that involve the addition of polymeric retention aid followed by anionic bridging coagulant. This is because nearly all such processes do involve the addition of at least one cationic polymer at some stage prior to the shearing.

As a result of the invention we are able to obtain an improved combination of dewatering and retention properties and appearance properties.

The invention is of particular value when cationic polymer is included in the suspension before the shearing for the purpose of providing dewatering and retention, since the invention then provides improvement in dewatering and retention properties. In preferred processes of the invention cationic polymer is included as a retention aid. It can be cationic starch for use as a retention aid as proposed in, for instance, U.S. Pat. No. 4,388,150, but is preferably a cationic synthetic polymer having a molecular weight sufficiently high that it gives retention properties. Generally therefore its molecular weight must be above 500,000 and usually it has intrinsic viscosity of at least 4 dl/g. Intrinsic viscosity is measured by a suspended level of viscometer on an aqueous composition at 25° C. buffered to pH 7.5.

The preferred cationic retention polymers are substantially water soluble copolymers of one or more ethylenically unsaturated monomers. Generally they are copolymers of acrylamide or other water soluble ethylenically unsaturated monomer with a cationic allyl monomer such as dialkyldimethylammoniumchloride (DADMAC) or a cationic acrylic monomer such as dialkylaminoalkyl(meth)acrylates or acrylamides, either as acid addition or preferably quaternary ammonium salts. The polymers can be wholly linear or slightly crosslinked as described in EP 202780. The polymers can be amphoteric, as the result of the inclusion of a small amount of anionic groups. Suitable high molecular weight cationic polymeric retention aids which can be used in the invention are described in, for instance, U.S. Pat. Nos. 4,753,710, 4,913,775 and EP-A-308752.

In processes of the invention of this general type using a high molecular weight cationic polymeric retention aid, it is often advantageous to pre-treat the suspension with other cationic polymer. This can be cationic starch (prior to a synthetic cationic polymeric retention aid) or other cationic strengthening resin or it can be a relatively low molecular weight highly charged cationic polymer that may modify the retention and dewatering properties. Suitable polymers of this type include polyethyleneimines, polyamines, polyDADMACS and dicyandiamide condensate polymers.

The invention also includes processes in which the cellulosic suspension is rendered cationic by the application of such polymers or is otherwise treated with such polymers, and a nonionic or anionic retention aid is then used. Such processes conducted using an anionic retention aid are described in EP-A-308752 and processes using non-ionic or anionic retention aids are described in EP-A-707673.

The invention is also of value when a cationic polymer, generally a highly charged low molecular weight cationic polymer such as any of those discussed above, is added at the thick stock stage, for instance to control pitch. Suitable low molecular weight cationic polymers are described in more detail in, for instance, EP-A-308752 and U.S. Pat. No. 4,913,775.

The dosages of the cationic polymers used in the invention can be within conventional ranges. Thus the dosage of high molecular weight retention aid is generally from 50 to 2000, often 100 to 1000, g/t and the dosage of any low molecular weight cationic polymer is generally in the range 100 to 3000, often 500 to 2000, g/t. The optimum amount of any polymer in any process is determined by routine experimentation in conventional manner.

Although the total amounts used in the invention is generally within conventional ranges, the actual amount required to give any particular retention or dewatering performance in any particular process will generally be less than in a conventional process where the optical brightener, dye or pigment is added at an early stage. Typically the amount of cationic retention aid can, in the invention, be at least 5% and often at least 10% less than the amount that is required when the optical brightener, dye or pigment is added at an earlier stage. In some instances it can be up to 20 to even 30% less. For instance typically the amount is 10 to 100, often around 20 to 50 g/t less than in conventional proceses.

The retention aid and any other previous polymer is added in conventional manner at a conventional position. It leads to flocculation and it is necessary in the invention, as is conventional, to degrade the flocs by shearing the suspension. Adequate shear may be achieved merely by flowing the suspension turbulently through a duct, in which event the retention aid can be added after for instance, the final centriscreen. Generally, however, the degradation is achieved by passing the suspension through a relatively high shear mixing stage such as a centriscreen or a fan pump.

Anionic bridging coagulant is then added (usually after the last point of high shear, eg at or approaching the head box) to the sheared suspension so as to aggregate the microflocs. This general technique is often referred to as supercoagulation or as microparticulate retention since most of the suitable anionic bridging coagulants are microparticulate materials.

The preferred material is bentonite, that is to say a swelling clay which is usually based on a smectite, hectorite or montmorillonite clay structure. However it is also possible to use other inorganic anionic microparticulate or colloidal materials such as colloidal silica, polysilicate microgel, polysilicic acid microgel and aluminum modified versions of these (see for instance U.S. Pat. No. 4,643,801, EP-A-359552 and EP-A-348366). Anionic organic microparticulate materials can also be used. Thus anionic organic polymeric emulsions can be used. The emulsified polymer particles may be insoluble due to being formed of a copolymer of water soluble anionic monomer and one or more insoluble monomers such as ethyl acrylate, but preferably the polymeric emulsion is a crosslinked microemulsion of water soluble monomer material.

The particle size of the microparticulate material is generally below 2 $\mu$m, preferably below 1 $\mu$m and sometimes below 0.1 $\mu$m. For instance anionic crosslinked polymer emulsions having a size of 0.01 to 0.2 $\mu$m can be used. Preferably however, the bridging coagulant is bentonite.

The amount of bridging coagulant is usually at least 300 g/t and often at least 1000 g/t, for instance up to 3000 or even 5000 g/t.

The anionic dye, pigment or optical brightener can be added to the suspension in whatever amount is conventional for that particular material for the effect that is desired. For instance commercial optical brightener compositions (such as the material sold under the trade name Blanchophor PO1) is typically used in amounts of 500 to 5000, often 1000 to 3000, g/t. The invention does allow a reduction in the amount of dye, pigment or optical brightener while maintaining equivalent visual effect, for instance, with reductions of 5 to 30% being typical. However it is usually preferred to use whatever amount of optical brightener, dye or pigment at the final stage that gives the desired visual appearance irrespective of how much might have been appropriate if it had been added at an earlier stage.

The cellulosic suspension may be made from any conventional fed stocks and may be clean or dirty. It may be filled or unfilled. If it is filled, the amount of filler in the suspension is typically 10 to 50% by weight of the total solid in the suspension. Conventional fillers may be used.

The following is an example.

EXAMPLE

A process was conducted in accordance with the general teaching of U.S. Pat. No. 4,913,775. Thus filler was mixed into the suspension followed by 3.5 kg/t cationic starch followed by 500 g/t polyDADMAC (IV about 1 dl/g) followed by 200 g/t high molecular weight cationic polymer followed by shearing in the centriscreen followed by 1.5 kg/t bentonite. The cationic polymer was a copolymer of acrylamide and dimethylaminoethylacrylate quaternary salt having IV around 7 to 10 dl/g.

In a first process, optical brightener was added before the filler in an amount of from 1 to 3 kg/t.

In a second process substantially the same amount of optical brightener was added after the starch but before the polyDADMAC.

In a third process substantially the same amount of optical brightener was added with the bentonite, as an aqueous composition containing both bentonite and the optical brightener.

It was found that the amount of cationic retention aid in the third process could be reduced by about 30 g/t (i.e. to 170 g/t) compared to the amount used in the first and second processes without any loss of dewatering and retention performance. Thus the third process, according to the invention, gave a 15% saving in cationic retention aid without any loss in dewatering or retention performance and while maintaining visual appearance.

What is claimed is:

1. A process for making paper or paper board comprising forming an aqueous cellulosic suspension, adding a polymeric retention aid to the suspension to form flocs, degrading the flocs by shearing the suspension to form microflocs, aggregating the microflocs by adding to the suspension an aqueous composition of anionic bridging coagulant, draining the aggregated suspension to form a sheet, and drying the sheet, wherein a cationic polymer is included in the suspension before the shearing and an anionic dye, pigment or optical brightening agent for the paper or paper board is added to the suspension substantially with the aqueous composition of anionic bridging coagulant.

2. A process according to claim 1 in which the polymeric retention aid is selected from cationic starch and synthetic water soluble cationic polymer retention aids having intrinsic viscosity at least 4 dl/g.

3. A process according to claim 1 in which the polymeric retention aid comprises a water soluble cationic synthetic polymer formed from one or more ethylenically unsaturated monomers and having intrinsic viscosity of at least 4 dl/g.

4. A process according to claim 1 in which a cationic polymer is added to the suspension before the polymeric retention aid.

5. A process according to claim 4 in which the cationic polymer which is added before the retention aid is selected from polyDADMAC, polyimine, polyamine and dicyandiamide polymers.

6. A process according to claim 1 in which the anionic optical brightening agent, dye or pigment is included in the aqueous composition of anionic bridging coagulant before the addition of that to the suspension.

7. A process according to claim 1 in which the anionic bridging coagulant is selected from organic and inorganic microparticulate materials.

8. A process according to claim 1 in which the anionic bridging coagulant comprises bentonite.

9. A process according to claim 1 in which anionic optical brightener is included with the anionic bridging coagulant.

10. A process for making paper or paper board comprising forming an aqueous cellulosic suspension, adding a polymeric retention aid selected from the group consisting of cationic starch and synthetic water soluble cationic polymer retention aids having an intrinsic viscosity at least 4 dl/g to the suspension to form flocs, degrading the flocs by shearing the suspension to form microflocs, aggregating the microflocs by adding to the suspension an aqueous composition of anionic bridging coagulant selected from the group consisting of organic acid and inorganic microparticulate materials, draining the aggregated suspension to form a sheet, and drying the sheet, wherein a cationic polymer is included in the suspension before the shearing and an anionic dye, pigment or optical brightening agent for the paper or paper board is added to the suspension substantially with the aqueous composition of anionic bridging coagulant.

11. A process according to claim 10 in which the polymeric retention aid comprises a water soluble cationic synthetic polymer formed from one or more ethylenically unsaturated monomers and having intrinsic viscosity of at least 4 dl/g.

12. A process according to claim 10 in which the anionic bridging coagulant comprises bentonite.

* * * * *